United States Patent [19]

Borer et al.

[11] Patent Number: 4,476,071

[45] Date of Patent: Oct. 9, 1984

[54] PROCESS FOR ROUNDING OFF GRANULAR PARTICLES OF SOLID MATERIAL

[75] Inventors: Werner Borer, Flurlingen, Switzerland; Janos Lukacs, Ettikon, Fed. Rep. of Germany; Hugo Spalinger, Hemmental, Switzerland

[73] Assignee: Swiss Aluminium Ltd., Chippis, Switzerland

[21] Appl. No.: 446,328

[22] Filed: Dec. 2, 1982

[30] Foreign Application Priority Data

Dec. 23, 1981 [CH] Switzerland ..... 8244/81

[51] Int. Cl.[3] ..... B01J 2/08

[52] U.S. Cl. ..... 264/15

[58] Field of Search ..... 264/15

[56] References Cited

U.S. PATENT DOCUMENTS

| | | | |
|---|---|---|---|
| 2,186,659 | 1/1940 | Vogt | 264/15 |
| 2,874,950 | 2/1959 | Pyzel | 264/15 |
| 4,246,208 | 1/1981 | Dundas | 264/15 |

*Primary Examiner*—James R. Hall

*Attorney, Agent, or Firm*—Bachman and LaPointe

[57] ABSTRACT

Granular solid particles, in particular hard, comminuted material of any given shape, are kept continuously in relative movement in a funnel-shaped container by means of a stream of liquid whereby they are rounded off. The rounded-off particles are suitable as filler material for wear-resistant coatings.

2 Claims, 1 Drawing Figure

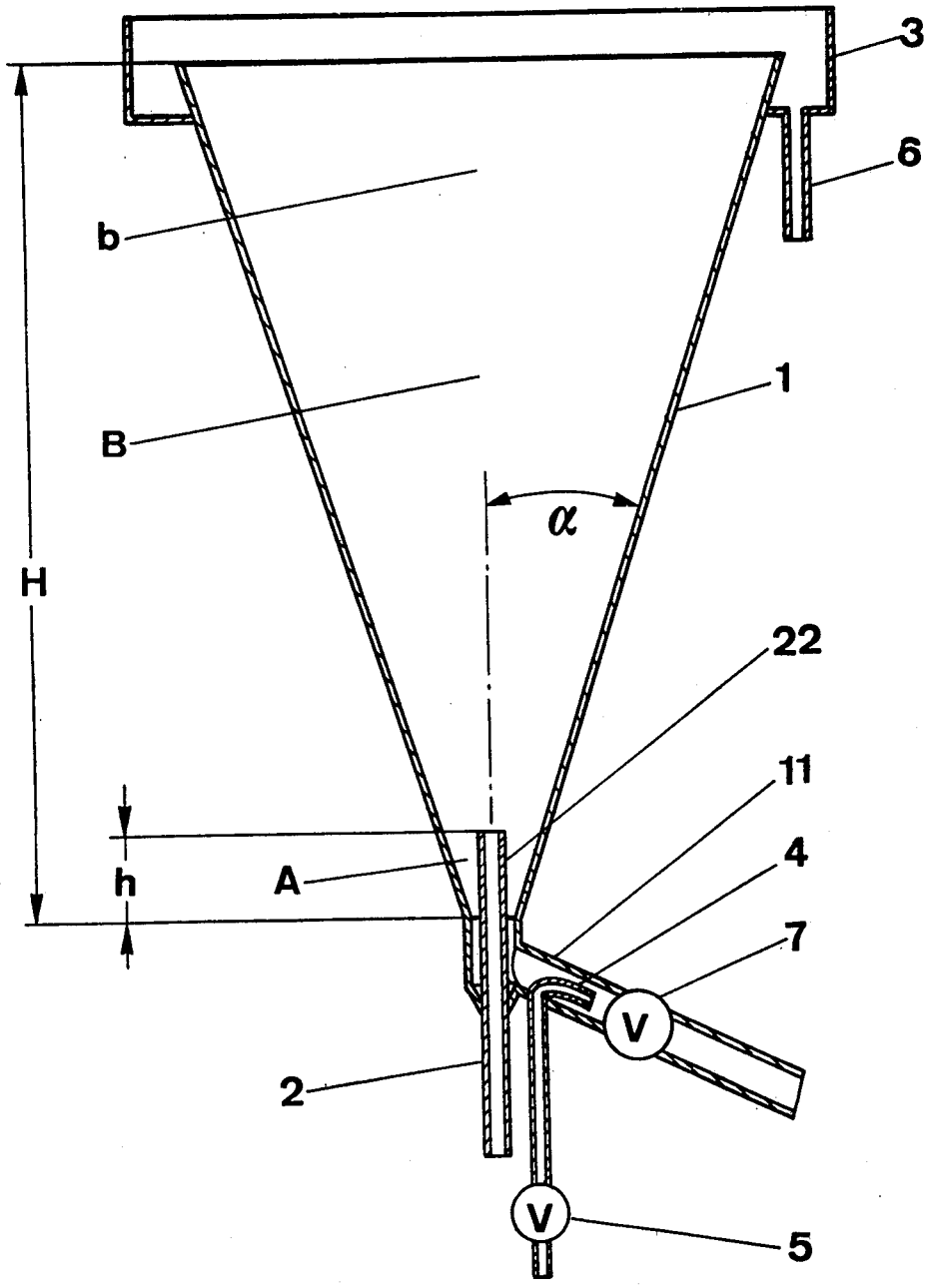
3
6
b
1
B
α
H
22
11
4
h
A
7
V
2
V
5

PROCESS FOR ROUNDING OFF GRANULAR PARTICLES OF SOLID MATERIAL

BACKGROUND OF THE INVENTION

The present invention relates to a process for rounding off granular particles of solid material, in particular granulated hard materials.

Rounded particles are already produced by means of various processes. A widely practiced method for example is the spraying of molten material in a gas stream. This process is employed mainly to produce spherical shaped metal powders, but is also used to make powders of refractory material. The process has the disadvantage, however, that it cannot be employed widely for hard materials, that is, oxides, carbides, borides and nitrides or refractory materials which have a hardness ≧7 on the Mohs hardness scale, the reason being that many of these materials have very high melting points and not all remain chemically stable in the molten state. Also, it is not always possible to prevent hollow spherical particles from forming during spraying.

Another known method for producing rounded particles is that of surface melting and thereby rounding off the particles in a high energy stream such as a plasma stream. Again, this process can be employed only for materials which are stable in the molten state, and is furthermore limited to particle sizes of about 100–200 μm.

Rounded solid bodies can, according to the GB Pat. Publ. No. 2 037 727, be produced by agglomeration or compaction of suitably fine powders followed by sintering. Such a process is also disadvantageous as the material must first be ground down to about 1/100 to 1/1000 of the size of the final, desired particle in order that a sinterable powder results. Also, the range of diameter of the final product is limited to about 0.4–5 mm.

Other processes which come into question, such as the sol-gel process and spray granulation, also suffer from disadvantages. The sol-gel process can be employed for only certain materials, and is used mainly for producing oxide spheres in the range ≦500 μm. The quality of the product from the spray process is inadequate. Usually only particles of low density can be made this way, due to the loose structure.

The object of the present invention is therefore to create a process for rounding off particulate materials of any particle shape, in particular hard, granulated materials, which does not exhibit the disadvantages of the above mentioned processes.

SUMMARY OF THE INVENTION

The foregoing object is achieved by way of the present invention wherein hard, comminuted granular particles of any given shape are maintained in continuous relative movement by contacting the particles with a liquid stream.

Usefully the particle size of the starting material lies in the range of 100 μm to 5 mm. The liquid medium chosen is of course so that it neither dissolves or dissolves in the starting material. For economic and practical reasons water is preferred for this purpose. The stream of liquid must be sufficiently intensive that mutual wear occurs between the particles impacting on each other.

BRIEF DESCRIPTION OF THE DRAWING

Further advantages, features and details of the invention will be made clear from the following description of preferred exemplified embodiments of the invention, and with the help of the drawing which shows schematically a cross section through the device suitable for carrying out the process.

DETAILED DESCRIPTION

A nozzle 2 for feeding in a liquid medium is situated at the lower end of a conical shaped funnel 1 provided with an outlet pipe 11. At the upper end of the funnel 1 is an overflow 3. In its simplest form the nozzle 2 is a cylindrical pipe. Usefully, the nozzle 2 projects into the interior of the funnel 1 thereby which allowing the efficiency of particle rounding to be increased. With this arrangement the conical part of the funnel 1 is such that it is sub-divided in its height H into a lower zone A and an upper zone B. The lower zone A is delimited by the height h which corresponds to the length of the part 22 of the nozzle 2 projecting into the conical part of the funnel. The height h is preferably about 1/10 of the height H. In order that those particles in the lower zone A also take part in the rounding process, additional liquid is fed in at intervals by means of a tubular auxiliary nozzle 4 which causes the stationary material in lower zone A to be transported into the upper zone B of the funnel 1, that is into the active zone. The pulsed on and off switching of the auxiliary nozzle 4 is effected in the simplest way by means of a magnetic valve 5. The overflow 3 is channel-shaped and at one place has a runout 6 where the fluid is drawn off together with the fines resulting from the rounding-off process. After the fines are separated from the liquid by using conventional means, the liquid can again be returned to the nozzle 2. The separating facility and the closed circuit for the liquid are not shown here for reason of clarity. When the starting material has been rounded off sufficiently, the supply of liquid is interrupted for a short time, and valve 7, in the form of a compressed air membrane valve, is opened so that the rounded-off material can flow out and be separated by means of a suitable device, not shown, from the liquid which is pumped back into the funnel.

It has been found that, in order to prevent the rounded particles from being flushed out of the funnel 1, the average rate of sedimentation in the liquid used of the particles to be rounded should be at least ten times the rate of flow of the liquid in the upper region b of the upper zone B of funnel 1, that is, near the overflow 3.

In order that the quantity of rounded particles produced per unit time is as large as possible and that all particles are rounded to the same degree, that is, homogeneously, it has been found advantageous to have the semi angle $\alpha$ of the funnel 1 between 14° and 22°. If angle $\alpha$ is too large, some of the rounded material tends to remain at the funnel wall.

On the other hand, if angle $\alpha$ is too small, the throughput is smaller. An optimum is reached when the angle $\alpha$ is 18°–19°. So that the particles to be rounded can not leave the funnel via the overflow 3, it is also advantageous to choose the height H of the funnel 1 such that it is at least 2.5 times the height of the bed of starting material before the rounding-off process starts. For a height H of 150 cm an optimum performance is achieved if the amount of material in the funnel at that time is about 50 kg and the flow rate of the liquid stream is 30 l/min. When the flow rate of liquid is 50 l/min, about 75 kg of starting material is optimal i.e. increasing the flow rate of the liquid to 50 l/min produces an approximately proportional increase in throughput, or, about 1.6 kg of starting material can be treated per l/min of liquid flow. This relationship is almost independent of material treated if its density is at least 2 g/cm$^3$. The flow rate of the liquid in upper zone B is usefully so arranged in zone b by means of nozzle 2 that it is not more than 1/20 of the average rate of sedimentation of the particles to be treated in the liquid in question. The throughput of liquid via the auxiliary nozzle 4 should usefully be at least twice the throughput supplied via nozzle 2.

Treating charges of 50 kg of starting material in a funnel of height H of 150 cm and angle $\alpha$ of 18.5° a sphericity as defined by Krummbein (W. Krummbein, Measurement and Geological Significance of Shape and Roundness of Sedimentary Particles; Journal of Sedimentary Petrology, 2, 64–72, 1941) of over 0.6 can be achieved after 55 hours.

EXAMPLE 1

A charge of 50 kg of silicon carbide abrasive granulate of grain F 14 (acc. to FEPA*), corresponding to a range of 1.19–1.68 mm, was loaded into a water-filled funnel 1 of height 150 cm and max. diameter 100 cm ($\alpha$=18.5°). Water was fed into the funnel 1 at a rate of 30 l/min via cylindrical nozzle 2 which has an inner diameter of 5 mm and projects 12 cm into the funnel 1. The auxiliary nozzle 4, which has an inner diameter of 4 mm, was made to operate for 20 seconds at 10 minute intervals, each time with a flow rate of 60 l/min. After 48 hours treatment, the residual material, 60% of the initial amount charged, was removed from the funnel. It had a sphericity of 0.6–0.7 on the Krummbein scale. The average grain size was 1.2 mm.

*Fédération européenne des fabricants de produits abrasifs

EXAMPLE 2

Using the same facility and the same conditions as in the first example a charge of 50 kg of corundum, grain SN 24 (acc. to FEPA), corresponding to a range of 0.64–0.84 was treated for 138 h. The material removed after this treatment had a sphericity of 0.6 and a roundness of 0.9. The yield of rounded material was 68% of the initial amount.

A higher yield can be obtained if appropriately sized starting material is employed.

The fines carried out via the overflow were caught in a settling tank and used for making micro-particulate material.

An application of the process according to the invention is such that, even after short treatment times of less than 1 hour, the bulk density of granular material can be significantly increased. For example, after treating silicon carbide, grain size SN 8 (acc. to FEPA), corresponding to a range of 2.0–2.8 mm, it was possible to increase its bulk density by 15% after 1 h, and after 3 h by 27% compared with the bulk density of the untreated material. Materials so treated are usefully employed for fire-proof or refractory applications, as they exhibit a superior resistance to oxidation than the untreated material. If used for grinding purposes, they also offer advantages, as the toughness of the rounded particles is much greater than that of non-rounded particles. Hard materials rounded off by the process according to the invention are also suitable for surface treatment of metals (shot peening). The rounded particulate material could also be employed as proppants for the oil industry.

The hard materials rounded off by the process according to the invention can also be employed for manufacturing wear-resistant parts or layers such as linings for mills, separators, cyclones or conveyance facilities, if they are used as filler material in plastic-resin masses or adhesives.

EXAMPLE 3

Parts of a ball mill which are subject to wear were coated with an approximately 1.5 mm thick layer of epoxy resin which contained as filler 55 vol.% of SiC particles which had been rounded off by the process according to the invention and had an average diameter of 355 $\mu$m. After the first 500 hours of service of the ball mill almost no signs of wear could be detected in the layer.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A process for rounding off granular irregular shaped solid particles and, more particularly, particles of hard comminuted granulate material of any given irregular shape comprising providing a chamber having an upper zone and a lower zone, providing a first nozzle for introducing a liquid stream into said chamber and a second nozzle for introducing additional liquid for transporting said particles from said lower zone to said upper zone wherein said additional liquid is fed through said second nozzle at a rate of at least twice the rate of feeding said liquid stream through said first nozzle such that the liquid stream in said upper zone of said chamber moves at a speed of not more than 1/10 the average rate of sedimentation of the particles treated such that the particles are kept in continuous relative movement by means of said liquid stream whereby the reciprocal wear of the particles on each other results in the rounding off of the particles.

2. A process according to claim 1 including providing an upper zone and a lower zone in said chamber wherein said liquid stream in said upper zone moves at a speed of not more than 1/20 the average rate of sedimentation of the particles treated.

* * * * *